US005131351A

United States Patent [19]

Farina

[11] Patent Number: 5,131,351

[45] Date of Patent: Jul. 21, 1992

[54] HEAT EXCHANGER PLUG

[76] Inventor: Alfred J. Farina, 1939 Anita Ct., Baldwin, N.Y. 11510

[21] Appl. No.: 740,052

[22] Filed: Aug. 5, 1991

[51] Int. Cl.[5] ..... F22B 21/00

[52] U.S. Cl. ..... 122/250 R; 122/14; 165/163

[58] Field of Search ..... 122/13.1, 18, 14, 245, 122/250 R; 165/163

[56] References Cited

U.S. PATENT DOCUMENTS 4,589,374 5/1986 Farina ..... 122/14

4,901,677 2/1990 Demetri ..... 122/250 R X

*Primary Examiner*—Edward G. Favors

[57] ABSTRACT

In a heat exchanger fueled by a metal-corroding heating gas, the use of a replaceable aluminum plug component which, because of its chemical affinity, corrodes first to thereby obviate the corroding of other non-replaceable metal components, to thereby contribute to eliminating malfunctioning due to corrosion. The construction of the plug also contributes to the heat transferring efficiency of the heat exchanger.

3 Claims, 2 Drawing Sheets

HEAT EXCHANGER PLUG

The present invention relates generally to improvements for a heat exchanger fueled by a gas-air mixture unavoidably having a chlorine content, and more particularly to such improvements which simultaneously enhance the heat transfer efficiency of this category of heat exchanger while obviating the corrosive effect of the heating gas used in its operation.

EXAMPLE OF THE PRIOR ART

Heat exchangers using a corrosive gas are well known, as exemplified by the heat exchanger co-invented by me as described and illustrated in U.S. Pat. No. 4,442,799 issued on Apr. 17, 1984. The operational mode contemplates trapping the heating gas in an internal heat exchange compartment, usually by a plug preventing the exiting of the gas therefrom, thereby allowing for a heat transfer between the heating gas and fluid, such as water, which flows through the helical turns of a conduit disposed in encircling relation about the internal heat exchange compartment and thus disposed also within the trapped heating gas within the compartment.

While structural features are embodied in these heat exchangers to improve the heat transfer and thus their efficiency of operation, the corrosion caused by the need to use corrosion-causing gas in the gas-air mixture fueling these heat exchangers has avoided solution and remains a significant shortcoming.

Broadly, it is an object of the present invention to provide an improved gas-fueled heat exchanger in the category and of the type of my prior heat exchanger, but overcoming the foregoing and other shortcomings of the prior art. More particularly, it is an object to confine the unavoidable corrosion of the heating gas to a readily replaceable component, to thereby leave in tact the remaining components, and thus obviate this problem for all practical purposes, all as will be more fully explained as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 1:
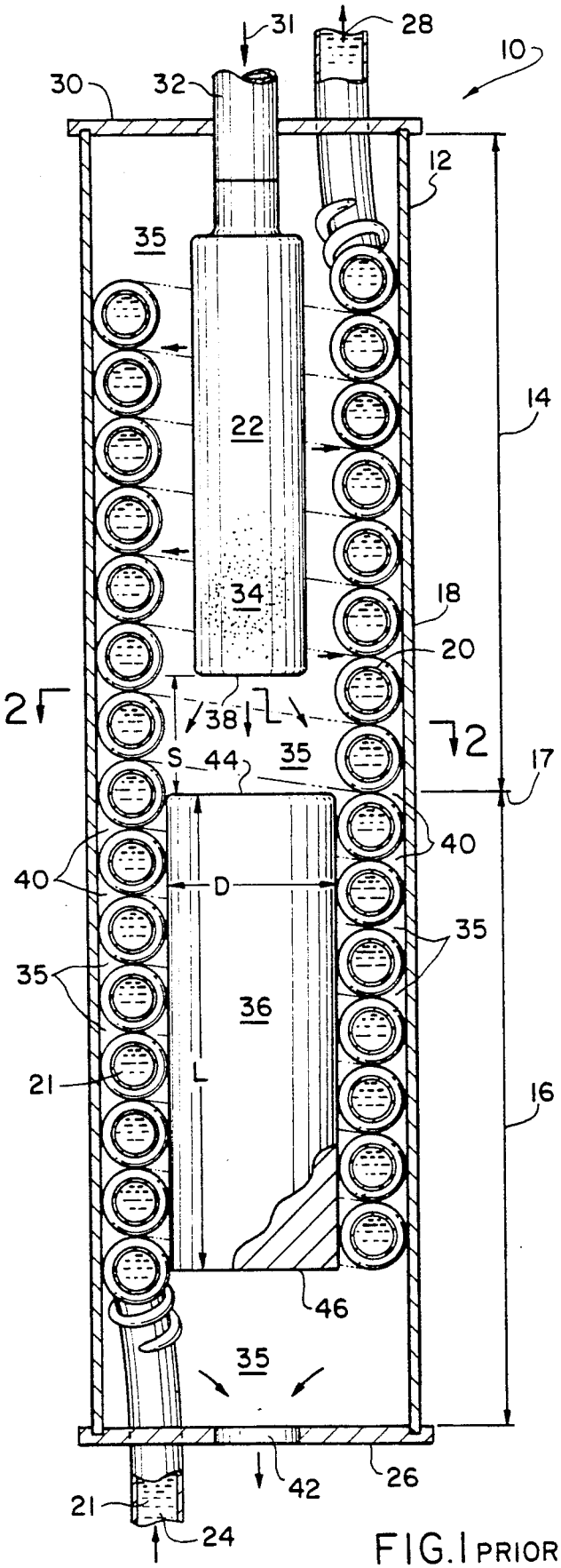
FIG. 1 PRIOR ART
FIG. 1 is a vertical cross section of a known heat exchanger to which the within inventive improvements are particularly applicable.
Figure 2:
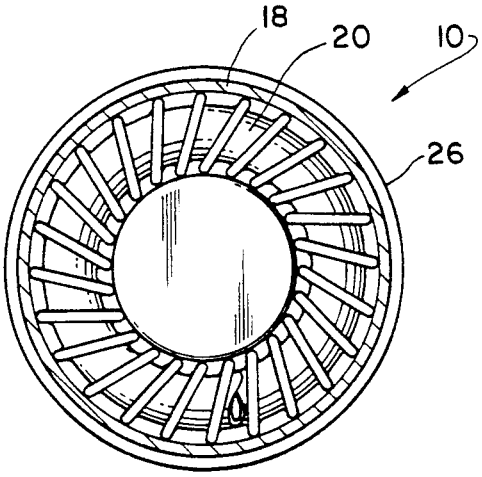
FIG. 2 is a horizontal cross section as taken along line 2—2 of FIG. 1.

In FIG. 1 is shown a heat exchanger 10 as it basically is illustrated and disclosed in my prior U.S. Pat. No. 4,442,799 issued on Apr. 17, 1984. Within a suitably insulated housing 12 heat exchanger 10 is divided into an upper section 14 and a lower section 16 with respect to a horizontal reference line 17. In contact with a vertical cylindrical wall 18 which bounds the internal heat exchange compartment of housing 12, is a fluid conduit formed as a closely wound helical coil or helical turns 20 made of corrugated stainless steel tubing. One of several sources of tubing 20 is Turbotec Products, Inc. of Windsor, Conn. Tubing 20 which characteristically has an extensive heat transfer surface, provides a closed conduit for water 21 (or other fluid) to be heated by a well-known type of gas-fueled combustion heater 22. Fluid input 24 to coil 20 is located in bottom plate 26, and the output 28 from said coil extends from top plate 30 of the unit 10.

Heater element 22 is centrally mounted on upper plate 30 where a gas/air mixture 31 which unavoidably has a chlorine content is provided at inlet 32 to supply the porous combustion surface 34 of the heater 22. During combustion, surface 34 becomes incandescent and radiates heat energy directly to coil 20. Additionally, hot gases 35, the products of combustion, circulate within upper section 14 and also supply heat energy to coil 20. A solid plug 36, of diameter D and length L is press fitted or otherwise held in surface contact with coil 20, and in this noted location receives radiant energy directly from the lower part 38 of heater 22. Adequate interposed spacing or clearance S avoids overheating of the plug 36. Absorbed heat to a lesser extent is conducted through plug 36 but is mostly transferred to coil 20 by conduction. Below the heat exchanger delineated by the reference line 17, hot gases 35, under slight positive pressure, and unavoidably laden with chlorine find their way through the coaxial space between plug 36 and wall 18 along the tortuous path 40 between and around the helical turns of coil 20. In effect, the helical turns of coil 20 within the length L become a counterflow heat exchanger in which, in a well-understood manner, heat exchange fluid, the coldest entering 21 absorbs available heat from the coolest exhaust gases 35 as they flow towards the exhaust port 42 in bottom plate 26.

It has been found in practice that when plug 36 is of solid construction material throughout, as in the above described U.S. Pat. No. 4,442,799, heat energy which is absorbed at the upper end 44 is unavoidably transferred to and thus dissipated into the cooled exhaust gases 35 at the lower end 46 as gas 35 leaves exhaust port 42, thus lowering the overall efficiency of unit 10. Even of greater adverse consequence, the chlorine content of the heating gas 35 causes corrosion of the stainless steel of the helical turns of conduit 20 resulting in leaks and other malfunctioning in the heat exchanger 10.

Figure 3:
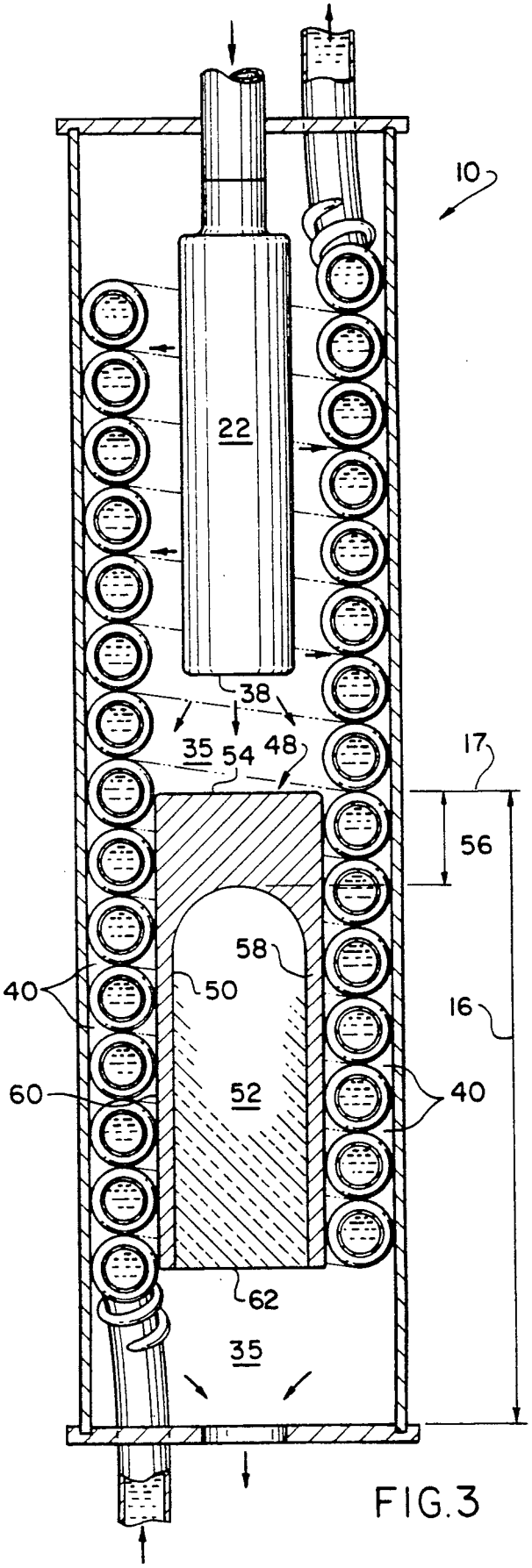
FIG. 3, like FIG. 1, is a vertical cross section, but of a heat exchanger according to the present invention.

In FIG. 3, to best demonstrate the advance over the prior art of the present invention, the heat exchanger 10 is, construction-wise and in operation, almost the same as just described in FIG. 1, except that a partially hollow plug member 48 is used to replace solid plug 36. Additionally, it will be understood that plug 48 is but one of plural identical replacement plugs, to be used one at a time, wherein the first used is removed and disposed of and replaced by a successor. Following this practice obviates the corrosion of the stainless steel conduit 20 previously noted. This is achieved by selecting for the construction material of the plug 48 aluminum which has a greater affinity for the chlorine content of the heating ga 35 than the stainless steel construction material of the conduit 20, such that in chemically reacting with the aluminum plug 48 said chlorine in effect is dissapated and thus does not corrosively attack or react with the coil or conduit 20. Since the plug 48 is readily removable from its spanning relation between the opposite facing selected number of helical turns of the conduit 20 adjacent the exit end of the unit 10 and, of course, the coiled conduit 20 is not so similarly readily removable, the intentional corroding of plug 48 is not a serious shortcoming and represents a significant advance in operating a heat exchanger in the category of concern.

Continuing with the comparison of the inventive and prior art plugs 48 and 36, these plugs can in practice have the same diameter D and length L, and are similarly positioned in the heat exchanger 10. Plug 48 thus serves to channel exhaust gases 35 through path 40, to absorb energy from the lower end 38 of heater 22 and redistribute this heat energy to coil 20 by conduction as did plug 36. It is to be noted, however, that dispensing with a solid configuration that plug 48 has a blind bore or opening 50 within, that is filled optionally partly or fully with thermal insulation 52. Upper end 54 is made with a substantial thickness 56 and bore 50 is configured to reduce wall 58 gradually to avoid overheating of top end 54 by heat emission from heater end 38. This formation of plug 48 also allows for a more linear temperature gradient from top 54 to bottom 62 along the outer surface 60 in contact with coil 20. The lower end 62 cooperates with insulation 52 and serves as a heat trap, as opposed to the solid heat emitting mass of the lower end 46 of the prior plug 36. Thus, the efficiency of heat transfer from hot exhaust gases 35 to cool heat exchange fluid 21 and of counterflow section 16 is greatly enhanced due to the aluminum construction material and revised construction of each replaceable plug 48.

While the plug for operating the heat exchanger herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. An improvement to a known heat exchanger of the type consisting of:

(a) a cylindrical heat exchanger body bounding a heat exchange compartment having opposite inlet and outlet ends;

(b) a gas-fueled heater means disposed to extend into said heat exchange compartment from said inlet end thereof operative to issue a heating gas having a chloride content;

(c) a fluid conduit formed of helical turns of stainless steel construction material disposed along the interior of said heat exchange compartment incident to a transfer of heat between said heating gas and fluid;

(d) a plug disposed to extend into said heat exchange compartment from said outlet end thereof in spanning relation between opposite facing selected number of conduit helical turns to oppose the exiting of said heating gas through said exit end and redirecting said chloride-containing gas to pass in heat exchange with said stainless steel helical turns of conduit for heat transfer therethrough to said fluid flowing within said conduit helical turns;

the improvement consisting of plural disposable replacements for said plug of preceding subparagraph (d), usable one at a time wherein the first used is disposed of and replaced by a successor, each said disposable replacement comprising:

(e) a plug of aluminum construction material selected for its greater affinity to chloride than said stainless steel construction material of said conduit so as to remove said chloride from said heating gas in a corrosive chemical reaction thereto, said replacement plug being removably likewise disposed in said heat exchange compartment exit end in spanning relation between opposite facing selected number of conduit helical turns adjacent said compartment exit end; and (f) said plug having a partial cylindrical opening thereinto bounded by a cylindrical wall of diminished width size in contact with said conduit helical turns so as to enhance heat transfer therethrough, whereby said plug in use is removed after corrosive reaction to said chlorine-content heating gas and replaced by a successor thereby sparing said stainless steel conduit from said corrosive reaction.

2. The improved replacement plug as claimed in claim 1 wherein said opening thereinto is from the end thereof remote from said heater means so as to form a wall bounding the bottom of said opening which is transverse to the flow of said heating gas through said compartment exit end located inwardly of said exit end.

3. The improved replacement plug as claimed in claim 2 wherein insulation material is inserted in said plug opening to obviate heat damage to said plug transverse wall.

* * * * *